United States Patent [19]

Carter et al.

[11] 3,994,468

[45] Nov. 30, 1976

[54] PREFABRICATED GLIDER

[75] Inventors: Floyd Carter; Marita Carter, both of Alameda, Calif.

[73] Assignee: Lawrence Peska Associates, Inc., New York, N.Y. ; a part interest

[22] Filed: Oct. 21, 1975

[21] Appl. No.: 624,432

[52] U.S. Cl. ..... 248/370; 297/281

[51] Int. Cl.[2] ..... A47J 47/16

[58] Field of Search ..... 248/370; 297/273, 281, 297/282

[56] References Cited

UNITED STATES PATENTS 929,207 7/1909 Gerlach ..... 248/370

3,047,334 7/1962 Vanderminden ..... 297/281 X

*Primary Examiner*—James C. Mitchell

*Attorney, Agent, or Firm*—Joel Halpern

[57] ABSTRACT

A prefabricated glider assembled from sub-assemblies by means of a set of uniformly sized bolts. The seat section is supported between a pair of rectilinear frame members which in turn are pivotally suspended respectively from the outer portion of a pair of base members. The entire assembly is made of wood and the stock which is used to form the rectilinear frame members and the base members are uniformly sized.

5 Claims, 4 Drawing Figures

PREFABRICATED GLIDER

BACKGROUND OF THE INVENTION

The present invention relates to a prefabricated glider and more particularly to such a glider as can be readily assembled for use by one who possesses little or no mechanical skill. The structure can easily be erected, for example, by a child.

Gliders have been in wide use heretofore, including those which are packaged in sections for fabrication in situ. However, such prior structures generally require some degree of mechanical aptitude in order to assemble the sections such that the glider is operable. Also, the prior glider assemblies generally provide for the swinging of the seat section within the supporting base member. This frequently leads to injuries of the legs since the bearing supports or pivotal elements are positioned closely adjacent the pivotal path of the seat section and, therefore, it has not been uncommon for the individuals reposing on the seat to catch a leg in the pivoting mechanism.

SUMMARY OF THE INVENTION

It is one object of this invention to provide a prefabricated glider which can be assembled with great ease.

Another object of the invention is the provision of a prefabricated glider wherein the seat section is supported in such manner as to substantially eliminate the risk of injury through interference with the pivoting mechanism.

Yet another object of the invention is the provision of a prefabricated glider which is constructed from similarly dimensioned wood stock and can be assembled by the use of uniform fastening means.

Other objects and advantages of the invention will become readily apparent from the ensuing description of the invention.

According to the present invention there is provided a prefabricated glider comprising: first and second base members positioned in spaced parallel relation; first and second rectilinear frame members pivotally mounted respectively on said first and second base members, said frame members each including a pair of spaced parallel upright elements and horizontally extending elements secured respectively across the top and bottom of said upright elements; first and second pairs of levers connected pivotally at their upper ends respectively to outer side portions of said first and second base members and pivotally connected at their lower ends to respective ones of said upright elements; and a seat section supported between said rectilinear frame members.

BRIEF DESCRIPTION OF THE DRAWINGS

In order that the invention may be more fully comprehended it will now be described, by way of example, with reference to the accompanying drawing in which.

DETAILED DESCRIPTION OF THE INVENTION

Figure 1:
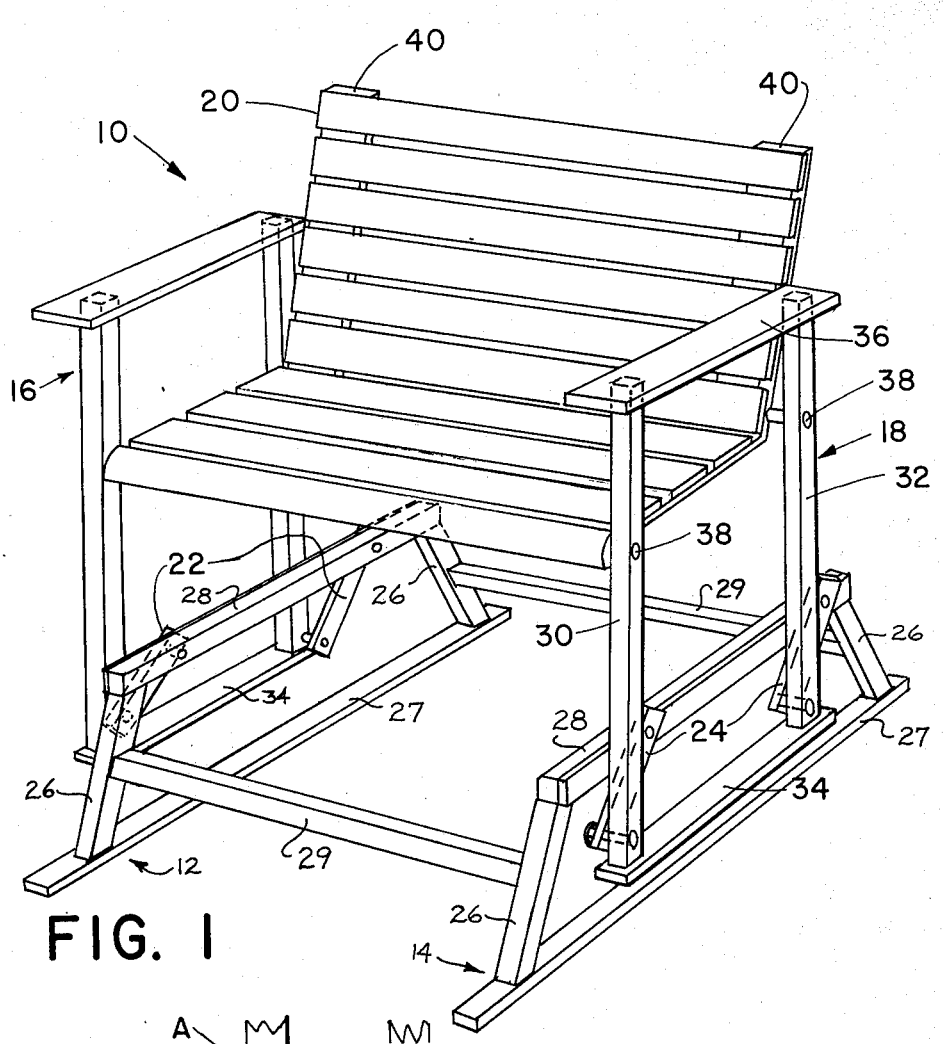
FIG. 1 is a front perspective view of a glider embodying the features of the invention.

Referring to FIG. 1 of the drawing there is shown a glider 10 in assembled form. The glider, in its unassembled form, includes a pair of base members 12, 14, a pair of "O" or rectilinear frame members 16, 18, a seat section 20 to be supported between the frame members, and two pairs of lever elements 22, 24 for pivotally suspending the respective frame members on their associated base members.

As shown in FIG. 1 the base members are arranged for assembly in spaced parallel relation. Each base member includes a pair of legs 26 and a horizontal connecting element 28. The legs are supported upon stringers 27 which are in turn cross braced by connecting members 29. The legs and connecting element are constructed of wood stock and are designed to provide sufficient strength to pivotally support the seat and frame members.

The frame members 16, 18 each include a pair of upright elements 30, 32 and a pair of horizontally extending elements 34, 36 which are secured respectively across the bottoms and tops of the upright elements. The rectilinear frame members are provided as a subassembly as are the base members. The upper horizontal element is located at an elevation such that it can serve as an arm rest for an individual reposing upon the seat.

The seat section 20 is supported pivotally by the frame members 16, 18 by bolts 38. The frame members are pivotally suspended from the respective base members through the medium of the pairs of levers 22, 24. As shown the levers are connected at their upper ends to the base members whereas they are connected at their lower ends to the lower ends of the upright elements. Preferably oversize apertures are provided in the base members and frames so as to loosely accomodate bolts 38 which, for ease of assembly, may be identical to bolts 38 which connect end support elements 40 located at the back of the seat to the frames.

It will be observed that the rectilinear frame members are suspended from the respective base members at the exterior of each base member. Thus, when the glider is placed in operation and the seat section swung to and fro it will pivot by means of the rectilinear frame such that the legs of the occupants are clear of the pivoting mechanism, i.e., the levers and their pivot bolts.

Figure 2:
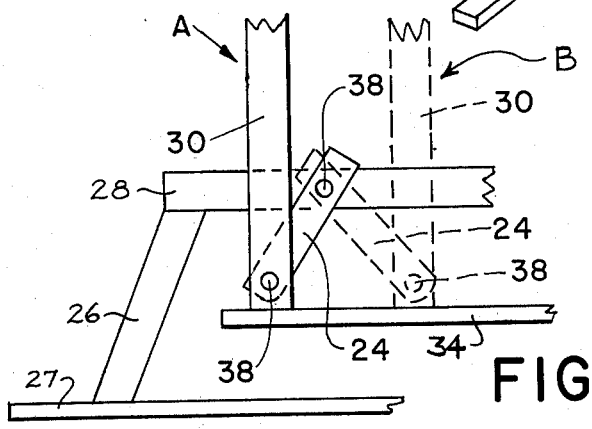
FIG. 2 is a broken schematic view showing the pivoting mechanism in different pivotal positions.
Figure 4:
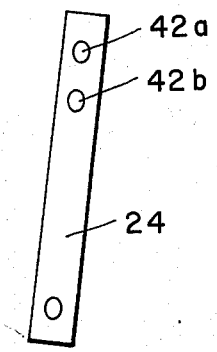
FIG. 4 is a front view of a lever having apertures for determining the amplitude of the pivotal or swinging movement of the glider.
Figure 3:
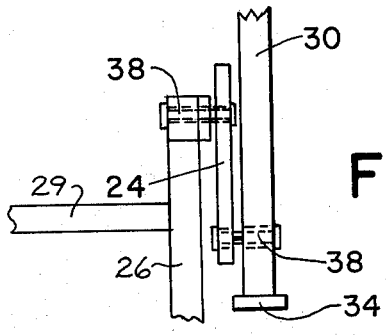
FIG. 3 is a front elevational view of the pivoting mechanism.

As shown in FIG. 2, frame pivots about bolt 38 through the medium of lever 24 from position A to position B, the amplitude of the pivotal or swinging movement being determined by the length of the levers. It is, therefore, posssible to easily replace the levers of one length with levers of a different length in order to accomodate persons of varying heights. FIG. 4 illustrates a modified form of lever in which a plurality of apertures 42*a*, 42*b* are provided to selectively determine the swing amplitude and height of the seat section above the ground or platform upon which the glider rests.

To facilitate assembly, as stated above, all of the bolts 38 are of uniform diameter and length so that they are thereby interchangeable throughout the assembly. All of the sub-assemblies are desirably made of wood, and for ease of manufacture the stock employed for the base and rectilinear frame members (the upright elements thereof) are of uniform dimensions.

From the foregoing description it will be seen that a glider of the prefabricated type has been provided which can be easily assembled and disassembled with a minimum of skill required. Through the disposition of the rectilinear frame on the exterior of the base member the risk of injury by contact of the occupant's legs with the pivoting mechanism has been substantially eliminated. The use of a lever having a plurality of apertures provides the glider with a capability for ready conversion to different elevations and swing amplitudes to conform with the desires of the occupants.

I claim:

1. A prefabricated glider comprising:

first and second base members positioned in spaced parallel relation;

first and second rectilinear frame members pivotally and detachably mounted respectively on said first and second base members, said frame members each including a pair of spaced parallel upright elements and horizontally extending elements secured respectively across the top and bottom of said upright elements;

first and second pairs of levers connected pivotally and detachably at their upper ends respectively to outer side portions of said first and second base members and pivotally and detachably connected at their lower ends to respective ones of said upright elements, each of said first and second pairs of levers having a plurality of vertically spaced apertures therein for regulation of the height of the seat and swing amplitude of the glider;

and a seat section supported between said rectilinear frame members.

2. A prefabricated glider according to claim 1, wherein said levers are pivotally connected at their upper ends to said base members and at their lower ends to said upright elements by means of loose fitting bolts, oversize apertures being provided in said base members, levers and upright elements for rotatably supporting said bolts.

3. A prefabricated glider according to claim 1, wherein said horizontally extending elements connected across the top of said upright elements are provided at an elevation to serve as arm rests for said seat section.

4. A prefabricated glider according to claim 2, wherein said seat section is supported on said frame members by means of bolts carried by said upright elements.

5. A prefabricated glider according to claim 1, wherein said base members, and rectilinear frame members are constructed of similarly dimensioned wood stock.

* * * * *